US005127850A

United States Patent [19]

Goodmann

[11] Patent Number: 5,127,850

[45] Date of Patent: Jul. 7, 1992

[54] METHOD AND MEANS FOR KEYING SIGNAL CONDUCTORS

[75] Inventor: Peter E. Goodmann, Fort Wayne, Ind.

[73] Assignee: Magnavox Government & Industrial Electronics Co., Fort Wayne, Ind.

[21] Appl. No.: 718,090

[22] Filed: Jun. 19, 1991

[51] Int. Cl.[5] ..... H01R 9/03

[52] U.S. Cl. ..... 439/502; 324/66; 367/20

[58] Field of Search ..... 439/502, 623, 624; 324/66, 538, 539, 540; 340/825.52; 379/21, 25, 326, 327, 397; 367/20, 22, 79

[56] References Cited

U.S. PATENT DOCUMENTS

| | | | |
|---|---|---|---|
| 3,436,722 | 4/1969 | Strange | 367/22 |
| 4,528,695 | 7/1985 | Khoe | 455/612 |
| 4,545,077 | 10/1985 | Drapala et al. | 455/612 |
| 4,680,809 | 7/1987 | Hartkoph et al. | 455/601 |
| 4,784,453 | 11/1988 | Shaw et al. | 350/96.16 |
| 4,859,019 | 8/1989 | Bevan | 350/96.16 |
| 4,864,489 | 9/1989 | Yasuhara et al. | 364/131 |
| 4,934,775 | 6/1990 | Koai | 350/96.14 |
| 5,007,699 | 4/1991 | Stout | 350/96.16 |
| 5,011,262 | 4/1991 | Layton | 350/96.29 |
| 5,058,080 | 10/1991 | Siems et al. | 367/20 |

*Primary Examiner*—Neil Abrams

*Attorney, Agent, or Firm*—John H. Crozier; Richard T. Seeger

[57] ABSTRACT

In a preferred embodiment, a cable for serially connecting segments in a multisegment array, at the terminus of which cable the position of a first conductor uniquely identifies that conductor as originating at the nearest segment, the position of a second conductor uniquely identifies that conductor as originating at the second nearest segment and so forth. In a further aspect of the invention, segments can be connected with any one of identical cable sections.

4 Claims, 2 Drawing Sheets

METHOD AND MEANS FOR KEYING SIGNAL CONDUCTORS

BACKGROUND OF THE INVENTION

1. Field of the Invention

The present invention relates to multiple signal conductors connecting a multisegment array generally and, more particularly, but not by way of limitation, to novel method and means of identifying at an array terminus the segment within which a particular signal originated or is received.

2. Background Art

Multisegment arrays are widely used in such varied applications as computer, telephone, and other types of communication networks, hydrophone arrays, and sensors buried in highways. Each such array is characterized by a communications cable serially joining the segments thereof and having a plurality of conductors. At each segment, a signal is inputted to or received from one or more of the conductors. The construction of the conductors varies depending on the application and the types of conductors to which the present application is applicable include individual electrical conductors, twisted wire pairs, coaxial cables, optical fibers, and pneumatic tubes, for example.

A particular problem with such arrays is the identification, at a terminus of the communications cable, the segment where a given conductor originates. Frequently, such identification is made by means of color coding or even trial-and-error. A substantial disadvantage of such an arrangement is that it is time consuming, often requiring having technicians located at both the terminus of the cable and at the segment being identified. A further disadvantage of such an arrangement is that sets of cable sections are not available to permit serially connecting segments without regard to which segments are connected by a particular cable section.

Accordingly, it is a principal object of the present invention to provide method and means for identifying the origin of a conductor at the terminus of a multiconductor cable serially connecting a multisegment array.

It is an additional object of the invention to provide such method and means that permits serial connection of segments in the array with identical cable sections.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others by providing, in a preferred embodiment, a cable for serially connecting segments in a multisegment array, at the terminus of which cable the position of a first conductor uniquely identifies that conductor as originating at the nearest segment, the position of a second conductor uniquely identifies that conductor as originating at the second nearest segment and so forth. In a further aspect of the invention, segments can be connected with any one of identical cable sections.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, in which.

DETAILED DESCRIPTION OF THE PREFERRED EMBODIMENTS

Figure 1:
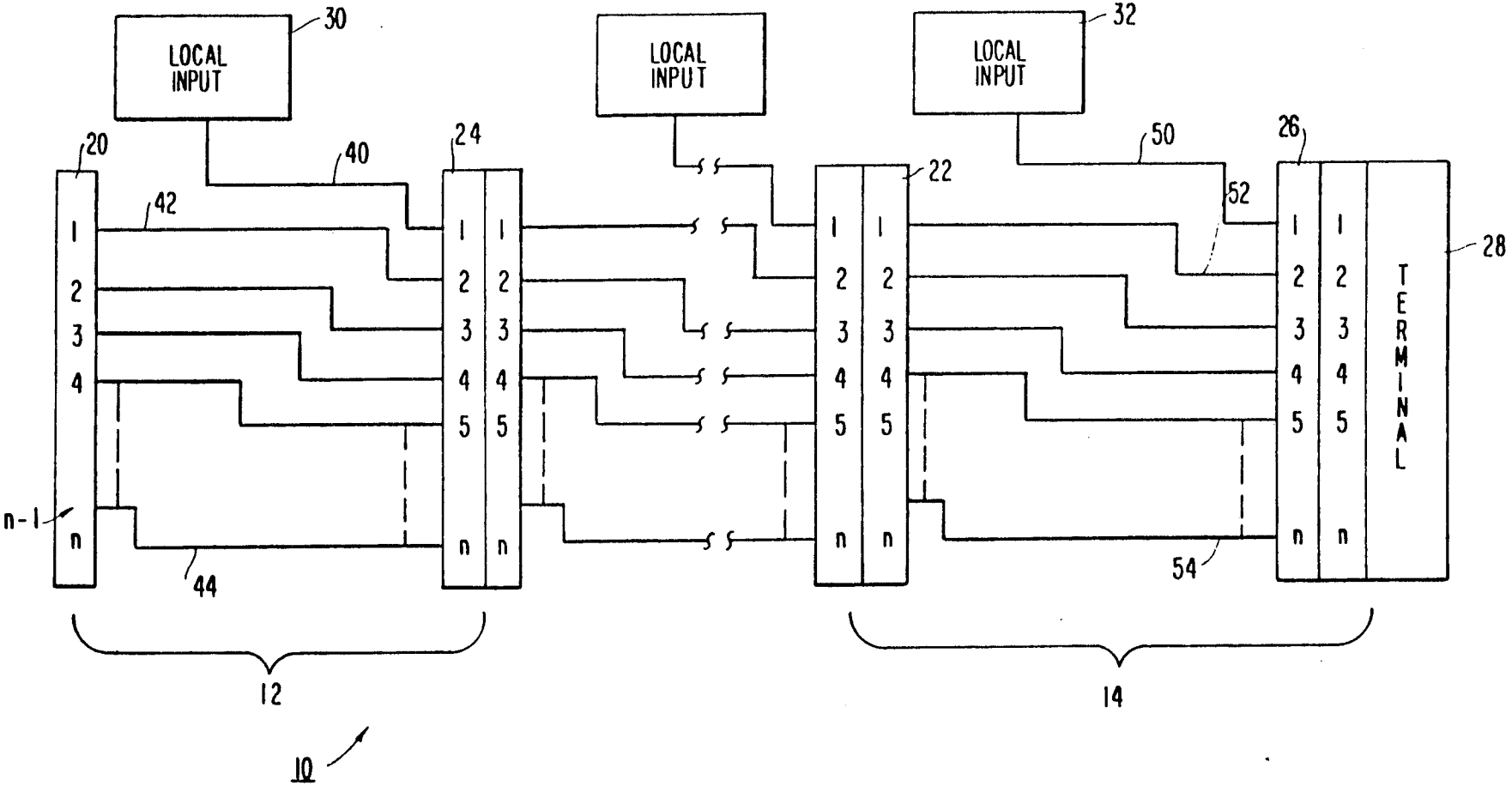
FIG. 1 illustrates schematically a multisegment array serially connected according to the present invention.

Referring now to the drawing figures, FIG. 1 illustrates a multisegment array, which may be one of any of the types noted above, generally indicated by the reference numeral 10, which includes a plurality of serially connected segments originating with a segment 12 and terminating with a segment 14. Segments 12 and 14 include, respectively, input connectors 20 and 22 and output connectors 24 and 26, with output connector 26 being connected to a terminal 28.

At segment 12, there is a local input device 30 and, at segment 14, there is a local input device 32. It will be understood that, at each segment in multisegment array 10, there will be a similar input device. It will also be understood that input devices may, instead in some applications, be output devices or they may be both input and output devices. In any case, there will be a conductor at terminal 28 connected to a specific device.

Referring to segment 12, particularly, input device 30 is connected by a conductor 40 to position "1" of output connector 24. A conductor 42 connects position "1" of input connector 20 to position "2" of output connector 24. Likewise, a conductor 44 connects position "n−1" of input connector 20 to position "n" of output connector 24. The arrangement of conductors between input and output connectors 22 and 26 at segment 14 is identical to that at segment 12, with local input 32 being connected by a conductor 50 to position "1" of output connector 26. Each of the other conductors at segment 14 connects one numbered position of input connector 22 to the next lower position of output connector 26. All such segments in array 10 have the same arrangement of conductors and connectors as do segments 12 and 14.

Thus, it will be seen that the position of a conductor at terminal 28 uniquely identifies the segment at which the conductor originates. The conductor at position "1" at terminal 28, conductor 50, originates at the nearest segment, segment 14. Conductor 52 at position "2" of terminal 28 originates at the segment adjacent segment 14, or the second nearest segment. Likewise, connector 54 at position "n" of terminal 28 originates at the segment in the "nth" position from the terminal.

Since the connectors and conductors comprising the cable sections at segments 12 and 14 are identical, when serially connecting segments, it makes no difference which particular cable section is used in a given segment, as the terminating positions at terminal 28 will always correctly indicate to which segment the position is connected.

Figure 2:
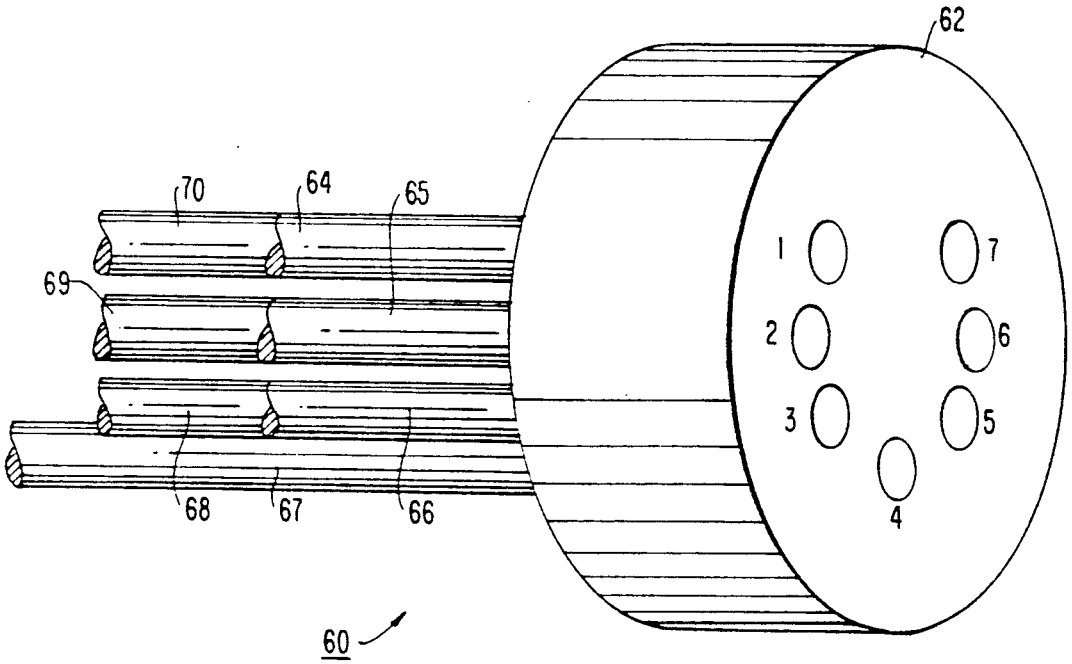
FIG. 2 is a front/side, fragmentary, perspective view of a cable and connector according to the present invention.

FIG. 2 depicts a cable/connector assembly according to the present invention, generally indicated by the reference numeral 60. Assembly 60 includes a connector 62 having seven output positions "1"–"7" asymmetrically disposed on the face thereof. Connected to positions "1"–"7" are seven conductors 64–70, respectively. Positions "1"–"7" are asymmetrically disposed so that a mating connector (not shown) can be coupled to connector 62 in only one orientation. In accordance with the above discussion with respect to FIG. 1, it will be understood that there is provided a connector (not shown) at the other end of conductors 64–70 having positions "1"–"7" similar to connector 62. However, it will be understood that conductor 65 will be connected to position "1" of that connector, etc., and that conductor 70 will be connected to position "6" of that connector. Conductor 64 will, of course, be connected to a local input/output device.

While, for clarity, only a few conductors have been illustrated, it will be understood that the present invention is capable of accommodating very large numbers of conductors.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A method of identifying the origin of conductors at the terminus of a plurality of cable sections, "n" or less in number, serially connecting a multisegment array, each of said cable sections having a plurality of conductors and having an input connector and an output connector at either end thereof, comprising: arranging the positions of said conductors at each said input connector and said output connector in a predetermined pattern of positions "n" in number and connecting a said conductor from position "1" on said input connector to position "2" on said output connector, connecting a said conductor from position "2" on said input connector to position "3" on said output connector, . . . and connecting a said conductor from position "n-1" on said input connector to position "n" on said output connector, and connecting position "1" on said output connector only to data input means in that seqment, such that, at the terminus of said cable, the position of each said conductor uniquely indicates the segment where said each said conductor originates and such can be visually determined from inspection of said positions of said conductors.

2. A method, as defined in claim 1, further comprising connecting a said conductor attached to position "1" on said output connector to an input and/or output device.

3. A cable for serially connecting a multisegment array, comprising:

(a) a plurality of cable sections, "n" or less in number, each comprising a plurality of conductors;

(b) an input connector and an output connector disposed at either end of each said conductor, said conductors terminating at said input and output connectors at a plurality of positions comprising a predetermined pattern;

(c) wherein said plurality of positions comprising said predetermined pattern is "n" in number and a said conductor connected to position "1" on said input connector is connected to position "2" on said output connector, a said conductor connected to position "2" on said input connector is connected to position "3" on said output connector, . . . and a said conductor connected to position "n−1" on said input connector is connected to position "n" on said output connector; and (d) position "1" on said output connector is connected only to data input means in that segment;

whereby, at the terminus of said cable, the position of a said conductor uniquely indicates the segment where said conductor originated and such can be visually determined by the inspection of said positions of said conductors.

4. A cable, as defined in claim 3, wherein a said conductor attached to position "1" on said output connector is attached to an input and/or output device.

* * * * *